United States Patent [19]

Helm et al.

[11] 3,963,582

[45] June 15, 1976

[54] METHOD AND APPARATUS FOR SUPPRESSING THE DEPOSITION OF CARBONACEOUS MATERIAL IN A COKE OVEN BATTERY

[75] Inventors: Edward J. Helm; Linwood G. Tucker, both of Pittsburgh, Pa.

[73] Assignee: Koppers Company, Inc., Pittsburgh, Pa.

[22] Filed: Nov. 26, 1974

[21] Appl. No.: 527,395

[52] U.S. Cl. ..... 201/2; 202/139; 202/141; 202/142; 202/143; 202/144; 202/241; 432/2

[51] Int. Cl.[2] ..... C10B 43/00; C10B 43/12

[58] Field of Search ..... 202/135, 139, 141, 142, 202/143, 144, 241; 432/2; 201/2

[56] References Cited

UNITED STATES PATENTS

| | | | |
|---|---|---|---|
| 2,216,983 | 10/1940 | Otto | 202/241 X |
| 2,302,728 | 11/1942 | Wethby | 202/241 X |
| 2,306,678 | 12/1942 | Van Ackeren | 202/143 |
| 3,123,540 | 3/1964 | Van Ackeren | 202/141 |
| 3,222,260 | 12/1965 | Becker | 202/241 X |

*Primary Examiner*—James H. Tayman, Jr.
*Attorney, Agent, or Firm*—Stanley J. Price, Jr.; Sherman H. Barber

[57] ABSTRACT

In one embodiment valve means are provided in the pipe connecting the fuel gas main and air supply main to the respective headers to simultaneously supply a portion of the air to the headers associated with the "on" flues and a portion of the air to the headers associated with the "off" flues. The air supplied to the headers associated with the "on" flues mixes with and dilutes the rich fuel gas to suppress the tendency to deposit carbon in the vertical riser ducts of the "on" flues. The air supplied to the headers associated with the "off" flues removes the carbonaceous material deposited in the vertical riser ducts of the "off" flues. In another embodiment induction or recirculation ducts are provided between the vertical riser ducts of interconnected flues to admix a portion of the waste gas from the "off" flues with the rich fuel gas flowing upwardly through the vertical riser ducts of the "on" flues. Reversing valve means are provided to supply air or lean gas through the headers to all of the vertical riser ducts of the "off" flues for admixture with the waste gas conveyed through the induction or recirculation ducts to the vertical riser ducts of the "on" flues to dilute the rich fuel gas flowing upwardly through the vertical riser ducts of the "on" flues and suppress the tendency of carbon deposition in the vertical riser ducts of the "on" flues.

11 Claims, 12 Drawing Figures

METHOD AND APPARATUS FOR SUPPRESSING THE DEPOSITION OF CARBONACEOUS MATERIAL IN A COKE OVEN BATTERY

BACKGROUND OF THE INVENTION

1. Field of the Invention

This invention relates to a method and apparatus for suppressing the deposition of carbonaceous material in a regenerative coke oven battery and more particularly to a method and apparatus for both suppressing the deposition of carbonaceous material and removing deposits of carbonaceous material in a regenerative coke oven battery.

2. Description of the Prior Art

U.S. Pat. No. 2,306,678 entitled "Coke Oven Structure" is directed to a coke oven battery that includes an induction or recirculation duct connecting the vertical risers of flues on opposite sides of the coke oven chamber. In the illustrated embodiment the induction duct extends horizontally through the supporting mat of the coke oven battery beneath the regenerator walls. With this arrangement a portion of the products of combustion or waste gas is withdrawn through the vertical riser duct in the off flue and conveyed through the induction duct into the vertical riser duct of the on flue. The waste gas dilutes the rich fuel gas flowing upwardly through the vertical riser to the on flue. When a fuel gas of high calorific value or a fuel gas that includes constituents that tend to decompose at relatively low temperatures is used air may be introduced into the induction duct and admixed with the waste gas. The air is used to dilute the fuel gas in the on flue riser duct with oxygen and suppress the tendency to deposit carbon in the on flue riser duct. The amount of air introduced into the induction duct is controlled by the size of the orifice cap removably secured to the open end of a branch conduit connected to the induction duct. This arrangement supplies air at atmospheric pressure to the induction duct and is dependent on the suction effect caused by the flow of waste gas through the induction duct. Also, the air supplied to the induction duct is admixed with the waste gas and conveyed only through the vertical riser ducts of the on flue where it is admixed with the rich fuel gas flowing upwardly through the vertical riser to the on flue. With this arrangement the induction duct is open to the atmosphere and is dependent on the flow of waste gas through the induction duct to provide a suction effect for the air. If a substantial deposition of carbon occurs in the vertical risers or the vertical riser passageways clog, the opening in the induction duct for the inlet of air now becomes an opening for the escape of gas into the basement of the coke oven battery and could result in a hazardous and unsafe condition. Also, where rich gas, i.e. a gas containing the light oils (benzol, toluol and xylol), is used in a battery having recirculation or induction ducts, it is necessary to use abnormally large quantities of excess air during combustion. The excess air is utilized to remove the carbon deposited in the vertical risers associated with the off flues. The use of excess air results in inefficient combustion and frequently in underjet ovens overheats and damages the nozzles in the off flues.

In U.S. Pat. No. 3,222,260 there is disclosed apparatus for supplying air simultaneously to the high and low burners in the off flue and to further supply decarbonizing air during a portion of the on period to the low burners in the on flues while fuel gas is being supplied to the high burners and thereafter supply air to the high burners in the on flue while fuel gas is being supplied to the low burners in the same flue. With this arrangement there are two rich gas ports or burners in each flue and air is only supplied to the burners not being supplied with rich gas so that the rich gas is not diluted with the air as it flows upwardly through the vertical risers and the air only serves to remove the deposited carbonaceous material and does not suppress the deposition of carbonaceous material. British Pat. No. 1,341,271 also discloses apparatus to supply controlled amounts of air under pressure to the off flues for the removal of carbonaceous deposits.

There is a need to suppress the deposition of carbon in the vertical risers of the on flues and to reduce the amount of excess air employed during combustion. There is also a need for a method and apparatus to supply air to both of the vertical riser ducts in interconnected flues in controlled amounts to simultaneously and effectively decarbonize the vertical riser ducts of the off flues and suppress the deposition of carbon in the vertical riser ducts of the on flues.

SUMMARY OF THE INVENTION

This invention is directed to a regenerative coke oven battery that includes a rich gas main or supply line and an air or second gas supply line and a plurality of headers connected to the supply lines and extending transversely thereto. The headers are connected by separate vertical riser ducts to a series of flues. The interconnected flues are arranged to operate alternately in an on or off combusion condition. Reversing valves are arranged to control the flow of rich gas and in one embodiment air or secondary gas from the main supply lines to the headers and the riser ducts associated therewith. The valves are arranged to supply the air or a second gas to one of the headers for admixture with the rich fuel gas flowing therethrough to dilute the rich fuel gas, preferably a rich fuel gas from which the light oils (benzol, toluol and xylol) have not been removed, and suppress the thermal decomposition of the rich fuel gas and the deposit of carbonaceous material in the riser ducts.

Means are provided in another embodiment to simultaneously supply a portion of air to the header associated with the on flues for admixture with the rich fuel gas and supply a portion of the air to the other header associated with the off flues so that air simultaneously dilutes the rich fuel gas and suppresses the deposition of carbon in the risers to the on flues and also removes at least a portion of the carbonaceous material deposited in the riser ducts associated with the off flues. It is preferred that between about 15% and 40% and most preferably about 25% by volume air based on the volume of the rich gas is supplied to the headers for the on flues in the respective on heating walls and between about 30% and 75% and most preferably about 50% by volume based on the volume of the rich gas is supplied to the headers for the off flues in the respective off heating walls. With this arrangement air is simultaneously admixed with the rich fuel gas and also decarbonizes the vertical riser ducts of the off flues.

In another embodiment induction or recirculation ducts are provided between the vertical riser ducts of interconnected flues and valve means are provided to supply either air or lean gas through the header to the vertical riser ducts of the off flues in the off heating walls for admixture with the waste gas flowing downwardly through the vertical riser ducts of the off flues. The admixture of waste gas and air or lean gas then flows through the induction ducts to the vertical riser ducts of the on flues to suppress the deposition of carbon in the vertical riser ducts of the on flues. Means are also provided to supply air under pressure to the headers associated with all of the riser ducts of both sets of interconnected flues while both of the flues are off flues during reversing of the heating cycle to thereby remove the deposits of carbonaceous material in both sets of vertical ducts. Air can also be supplied to both the on and off headers for a variable time during reverse by the use of a timer to stop the reversing operation in a neutral position for a variable preset time.

Accordingly, a principle feature of this invention is to suppress the deposition of carbonaceous material in the vertical riser ducts of the on flues.

Another feature of this invention is to reduce the amount of excess air employed in the combustion process when a rich fuel gas from which the light oils (benzol, toluol and xylol) have not been removed and yet suppress the deposition of carbon in the vertical riser associated with the on flue.

Still another feature of this invention is to simultaneously suppress the deposition of carbonaceous material in one group of riser ducts associated with the on flues and to remove the carbonaceous material deposited in the group of vertical riser ducts associated with the off flues.

These and other features of this invention will be more completely disclosed and described in the following specification, the accompanying drawings and the appended claims.

BRIEF DESCRIPTION OF THE DRAWINGS

FIG. 7 further illustrates the manner in which the headers and vertical riser ducts are connected through valving to the gas supply main and air supply conduit extending along the side of the coke oven battery.

DESCRIPTION OF THE PREFERRED EMBODIMENTS

Figure 1:
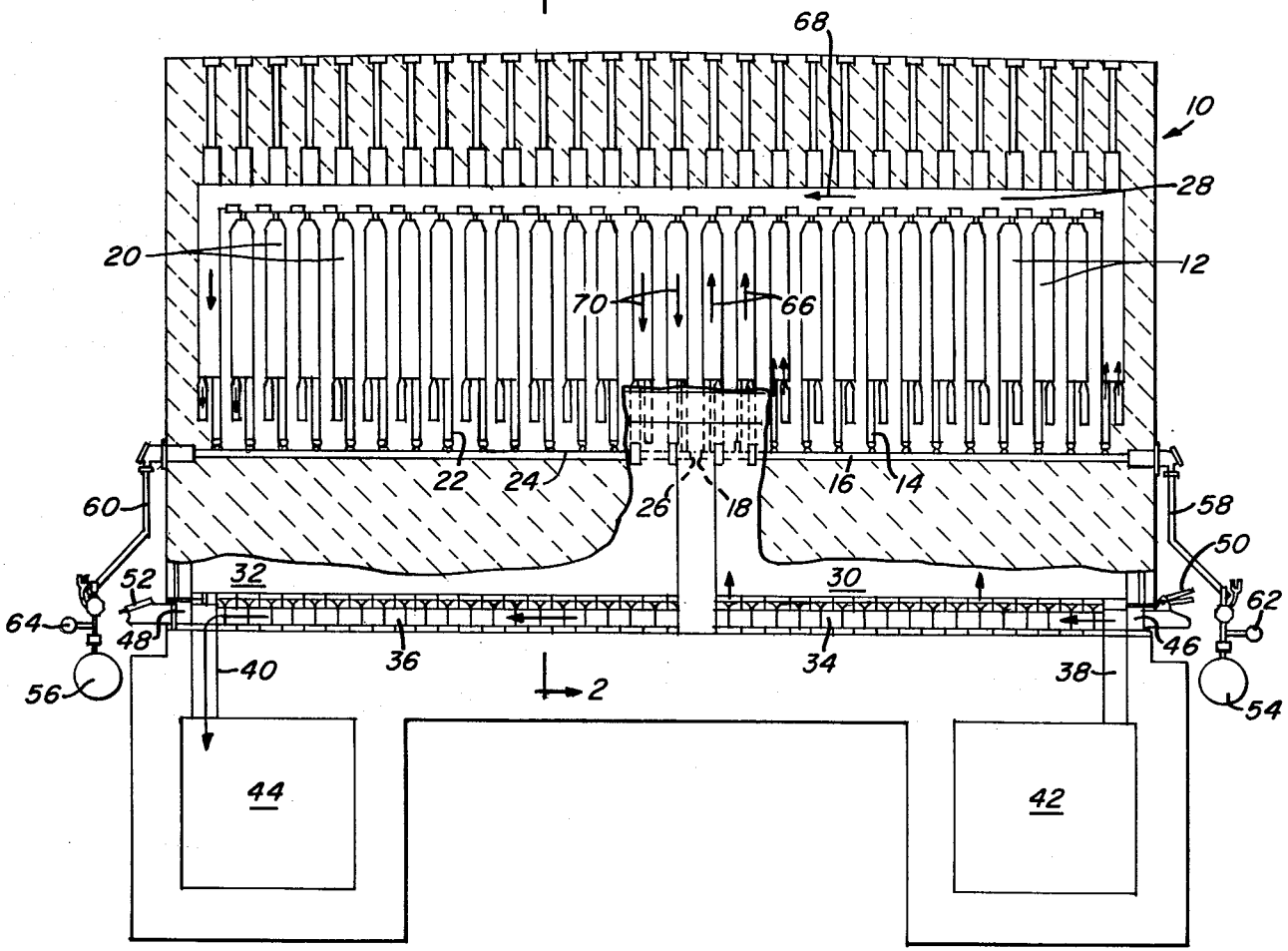
FIG. 1 is a composite section taken longitudinally through a gun flue type single divided coke oven battery, illustrating the manner in which the horizontal ducts and vertical riser ducts are connected through valving to the gas supply mains and air supply conduits extending along the sides of the coke oven battery.
Figure 2:
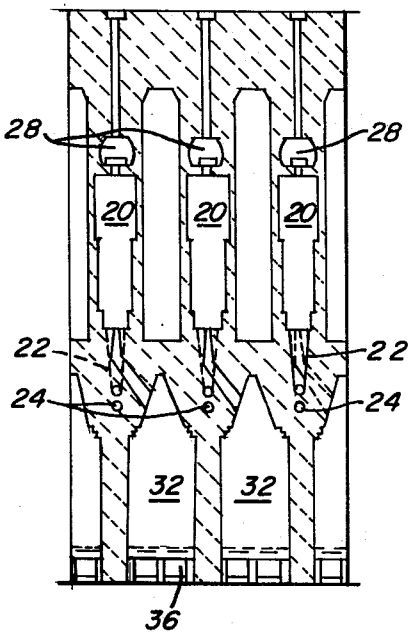
FIG. 2 is a view in section taken along the line II—II in FIG. 1, illustrating the manner in which the ducts supply gas and air to the heating flues in the gun flue type single divided coke oven battery.

Referring to the drawings and particularly to FIGS. 1 and 2 there is illustrated a single divided oven generally designated by the numeral 10 that has a plurality of vertical flues 12 connected by means of vertical riser ducts 14 to a common horizontal gas supply header 16. The header 16 terminates at 18 which in FIG. 1 is approximately along the longitudinal center of the coke oven battery. On the opposite side of the coke oven battery there are a plurality of vertical flues 20 connected by means of vertical riser ducts 22 to a common gas supply main 24. The gas supply main 24 terminates at 26 to provide two divided groups of vertical flues 12 and 20. A horizontal flue 28 extends transversely across the coke oven battery above the vertical flues 12 and 20. Beneath the flues 12 and 20 are regenerators 30 and 32 that are connected to sole flues 34 and 36. The adjacent sole flues on the side of the coke oven battery are connected by means of vertical passageways 38 and 40 to waste heat flues 42 and 44, respectively. There are provided air inlet openings 46 and 48 to the sole flues 34 and 36 with suitable valves 50 and 52 to control the flow of air into the respective sole flues and regenerators positioned thereabove.

Extending longitudinally along the sides of the coke oven batteries are gas mains 54 and 56 which are connected by means of piping 58 and 60 to the respective horizontal gas supply conduits 16 and 24. As will be later described in detail with reference to FIG. 11, air supply conduits 62 and 64 are connected to the respective pipes 58 and 60 to admix air with the fuel gas supplied from mains 54 and 56. With the divided coke oven battery illustrated in FIG. 1 fuel gas admixed with air is supplied from gas main 54 and air supply line 62 through piping 58 to the header 16. From the header 16 the diluted combustion gas flows upwardly through the vertical riser to the bank of flues 12 where it is admixed with air supplied through the sole flue 34 and regenerator 30 to the respective flues 12. Combusion takes place in the bank of flues 12 and the combustion or waste gases move upwardly as illustrated by the pair of arrows 66 in FIG. 1. The waste gas then flows horizontally through horizontal flues 28 in the direction illustrated by arrow 68. The waste gas then flows downwardly through the bank of flues 20 on the left side of FIG. 1 as illustrated by arrows 70, and downwardly through the regenerator 32 into sole flue 36 into the waste heat flue 44. Upon reversal combustion gas is supplied to the bank of flues 20 and the waste gases of combustion flow downwardly through the bank of flues 12. The manner in which dilution air is admixed with the combustion gas will be later discussed.

Figure 5:
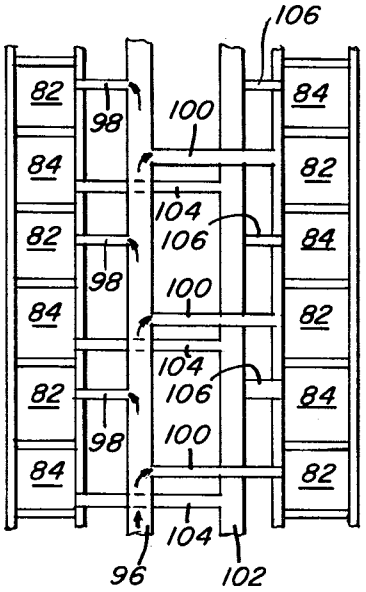
FIG. 5 is a diagrammatic illustration of the gas flow pattern for the diluted fuel gas to the twin flue type coke oven battery illustrated in FIGS. 3 and 4.
Figure 4:
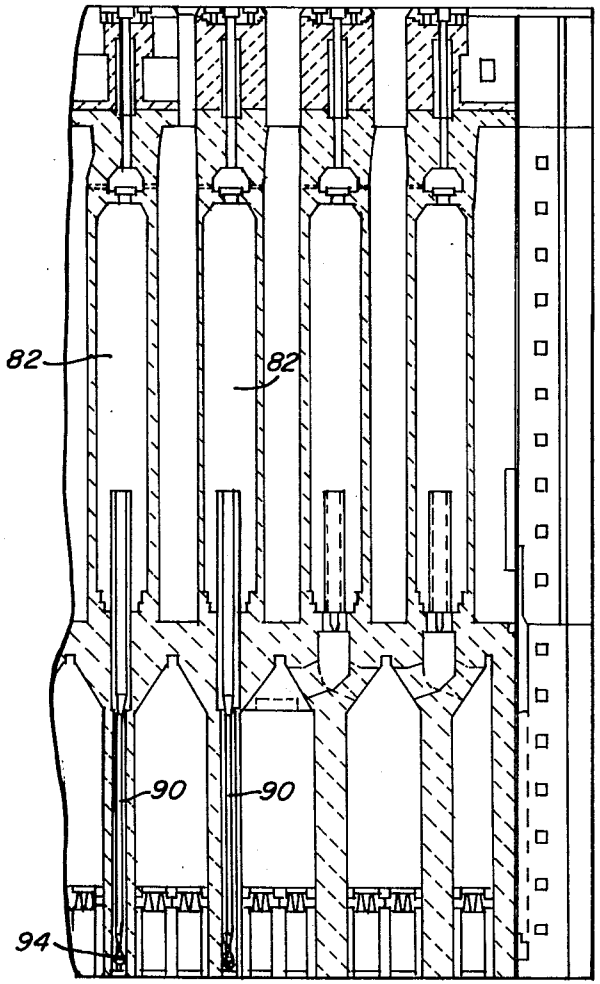
FIG. 4 is a composite section taken along the line IV—IV of FIG. 3 and illustrating the manner in which the fuel gas and air are supplied to the heating flues.
Figure 3:
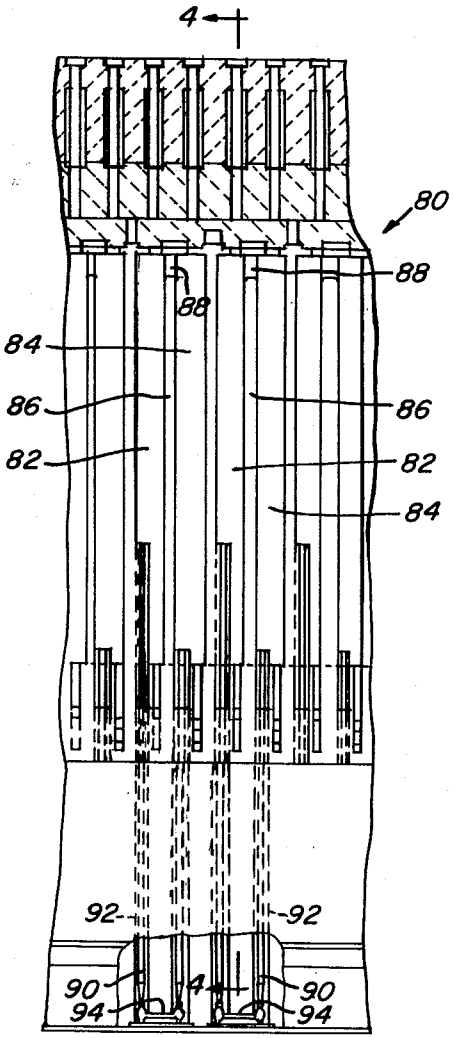
FIG. 3 is a view similar to FIG. 1, illustrating a portion of a twin flue underjet coke oven battery having waste gas recirculation between interconnected flues.
Figure 9:
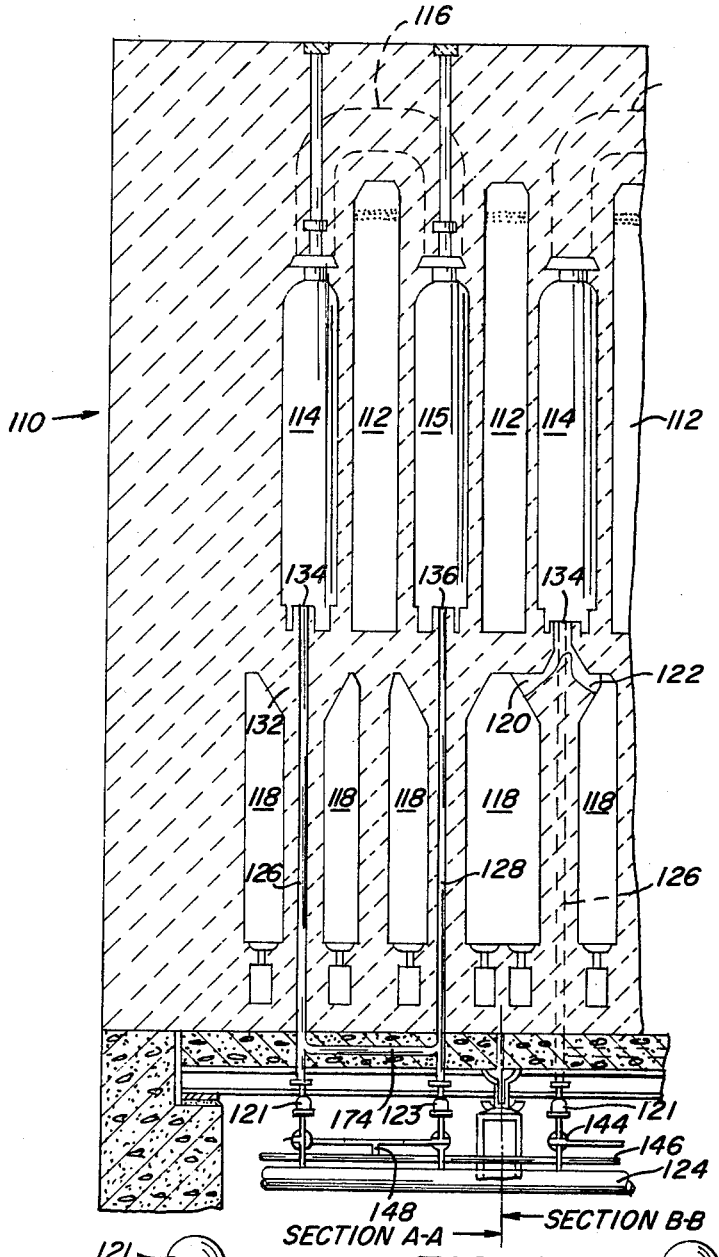
FIG. 9 is a composite section similar to FIG. 7, illustrating a coke oven battery having waste gas recirculation by means of an induction duct connecting the vertical riser ducts of heating flues that are connected by common crossover ducts.
Figure 12:
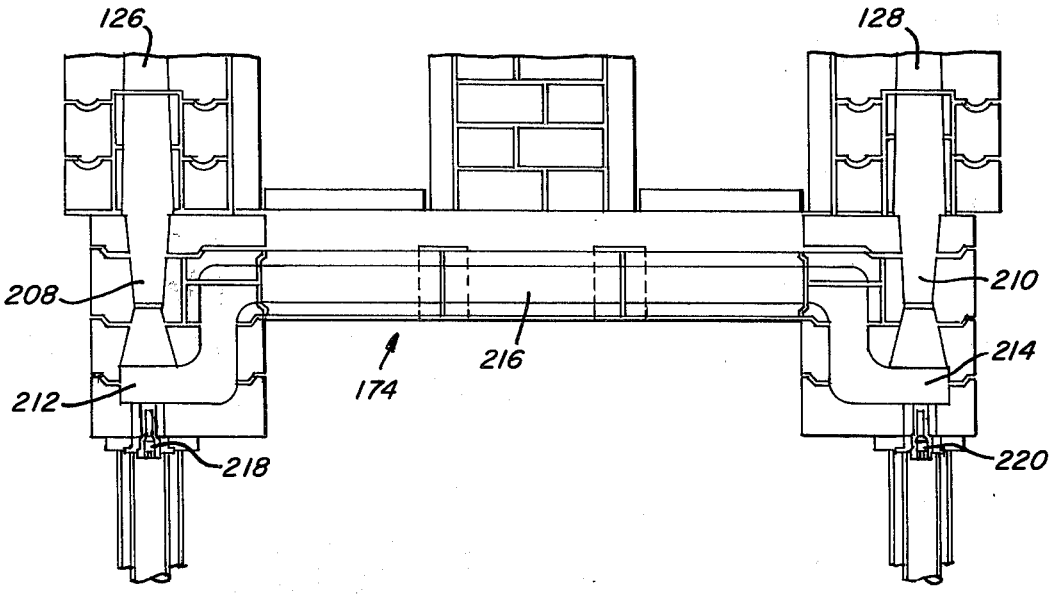
FIG. 12 is an enlarged view of the waste gas recirculation duct connecting the vertical riser ducts of heating flues and are connected by common crossover ducts.

FIGS. 3, 4 and 5 illustrate an underjet twin or hairpin type coke oven battery generally designated by the numeral 80 with waste gas recirculation. Pairs of vertical flues 82 and 84 have dividing walls 86 therebetween with an opening 88 adjacent the upper portion of the respective flues 82 and 84. Combustion gas admixed with air is supplied from longitudinal headers (not illustrated) positioned beneath the coke oven battery to the vertical riser ducts 90. The diluted combusion gas flows upwardly through the vertical riser ducts 90 to the respective flues 82 where it is admixed with air from the regenerators for combustion within flues 82. The gaseous products of combustion or waste gas flow upwardly through the flues 82 and through horizontal openings 88 to the adjacent flues 84. The waste gas flows downwardly through the adjacent flues 84 to the regenerators therebelow. Upon reversal of the coke oven battery combustion gas admixed with air, as later explained, is supplied through vertical risers 92 to the flues 84 where it is admixed with air from the regenerators and burned. The gaseous products of combustion or waste gas flow through the openings 88 and downwardly through the adjacent flues 82. There are provided waste gas recirculation ducts 94 that connect the vertical riser ducts 90 and 92 to permit recirculation of a portion of the waste gas for admixture with the combustion gas supplied through the vertical duct to the on flue. In FIG. 12 there is illustrated in detail a waste gas recirculation duct for a Becker type crossover coke oven in which the flues on opposite sides of the coke oven chamber are connected by means of a recirculation duct positioned in the pad of the coke oven battery as illustrated in FIG. 9. In the hairpin flue oven, as illustrated in FIG. 4, the recirculation ducts 94 connect adjacent flues on the same side of the coke oven chamber and are positioned in the brickwork above the coke oven battery pad. However, the recirculation ducts 94 are functionally similar to the waste gas recirculation ducts illustrated in detail in FIG. 12.

A schematic flow diagram for supplying diluted combustion gas to the respective flues as, for example, flues 82 and 84 is illustrated in FIG. 5. A gas supply conduit 96 supplies gas to branch conduits 98 connected to the respective flues 82. The same conduit 96 supplies combustion gas through branch conduits 100 to similar flues 82 in an adjacent bank of flues. Upon reversal combustion gas is supplied through conduit 102 to branch conduits 104 and 106 which, in turn, supply combustion gas to the flues designated by the numeral 84. The manner in which the air is admixed with the combustion gas will be discussed in detail in reference to FIGS. 9 and 10 and the same arrangement may be utilized with the hairpin type flue illustrated in FIGS. 3 and 4.

Figure 6:
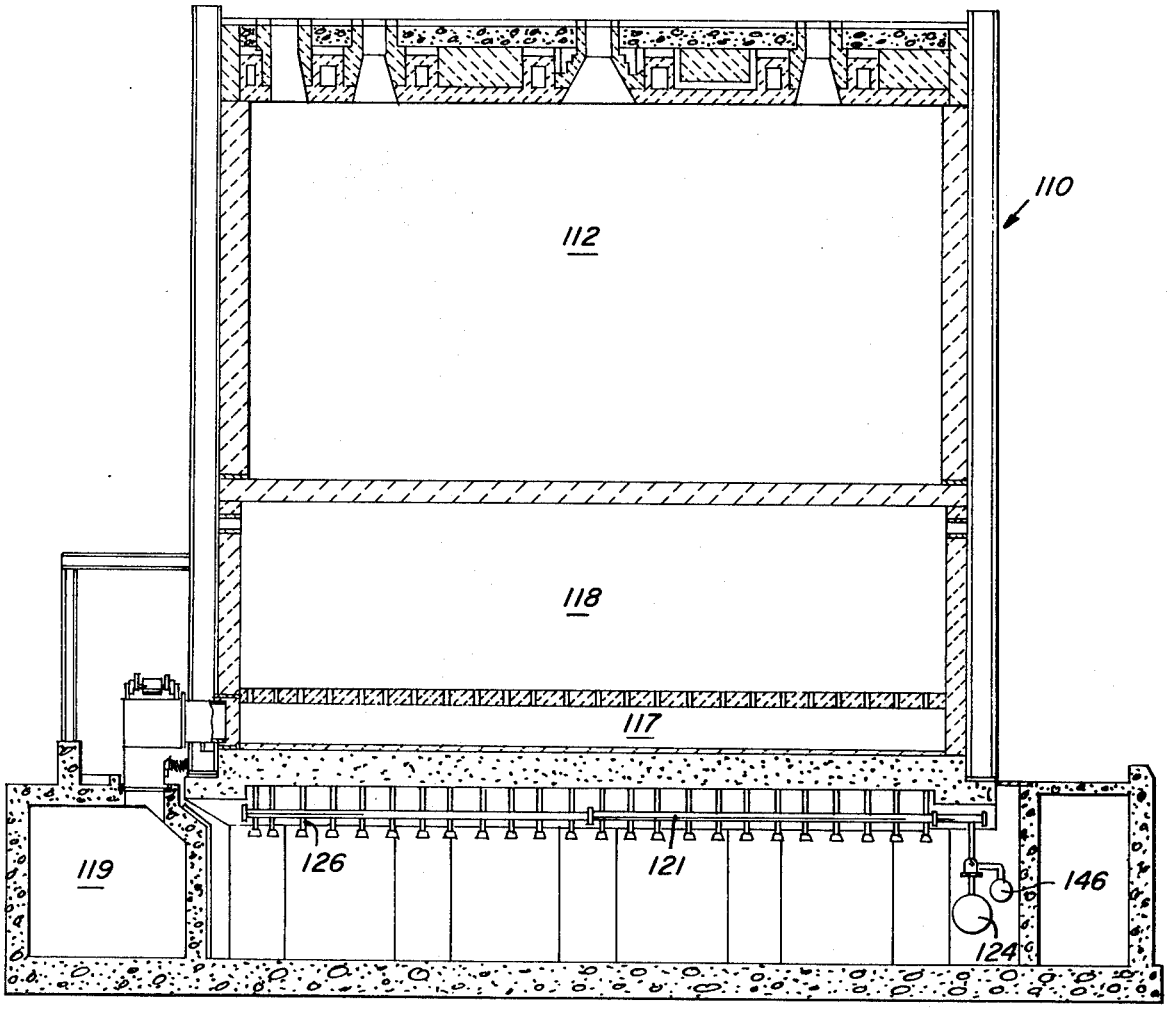
FIG. 6 is a view in vertical section and elevation taken transversely of an underjet coke oven battery without waste gas recirculation.
Figure 7:
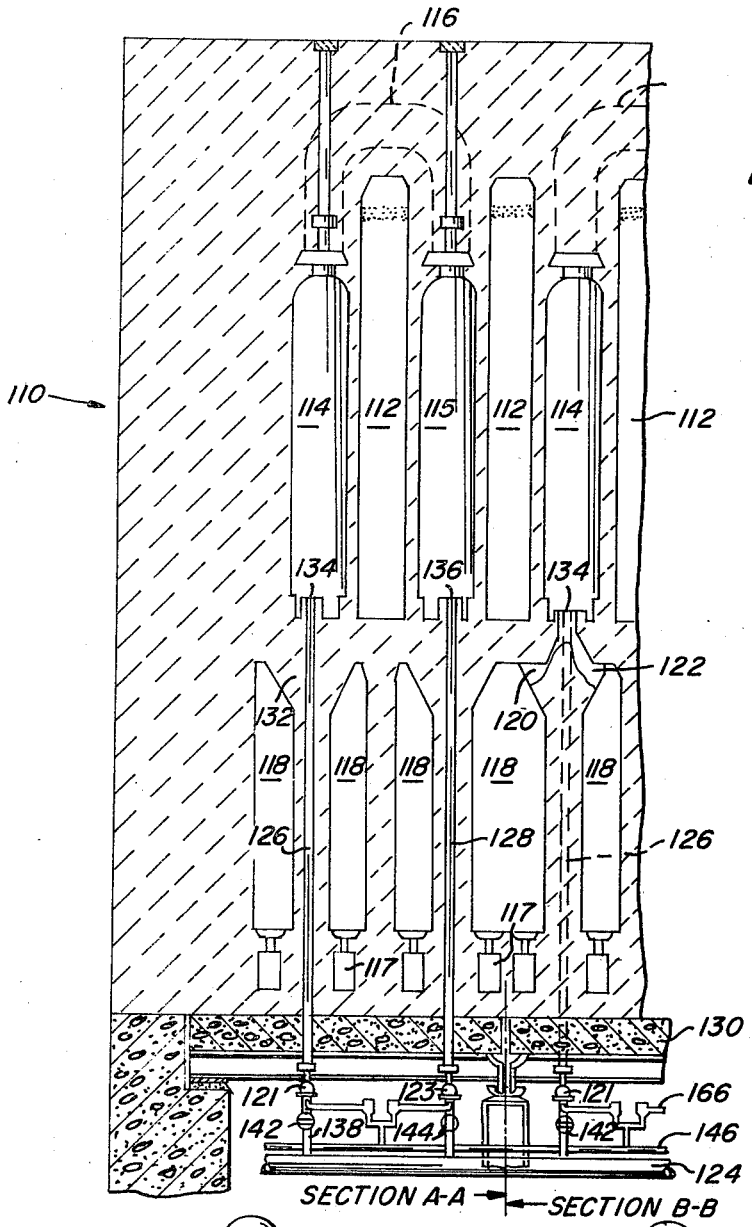
FIG. 7 is a composite section taken longitudinally through the coke oven battery illustrated in FIG. 6. Section A—A illustrates the vertical riser ducts for supplying gas through the regenerator walls to the ports or burners in the heating flues and section B—B illustrates the cross regenerators and the conduits connecting the regenerators to the heating flues.

Referring to FIGS. 6 and 7 there is illustrated a Becker type coke oven battery generally designated by the numeral 110 that includes a plurality of coke oven chambers 112 with heating walls on opposite sides thereof. The heating walls include a plurality or series of vertically disposed heating flues 114 and 115 on opposite sides of the coke oven chamber 112. The flues 114 are arranged in groups that are connected by crossover ducts 116 extending over the coke oven chamber therebetween. The arrangement of the crossover ducts connecting groups of flues on opposite sides of the coke oven chamber is illustrated in greater detail in U.S. Pat. No. 2,306,678.

The heating flues, as illustrated in section B—B of FIG. 7, are connected by cross regenerators 118 by means of conduits 120 and 122. The regenerators are arranged to preheat combustion air supplied to the preselected on flues. Transversely extending sole flues 117 extend crosswise beneath the regenerators 118 and convey the waste gas into a waste gas flue 119 that extends longitudinally along the side of the coke oven battery as illustrated in FIG. 6. The sole flues 117 are also arranged to supply air to the regenerators during the on cycle for a set of heating flues and regenerators connected thereto. On the opposite side of the coke oven battery there is a rich gas main or supply line 124 that extends along the length of the coke oven battery. Adjacent to the gas supply main 124 there is an air supply main 146. As later described, the gas main 124 and air supply main 146 are connected through suitable piping and valving to cross headers 121 and 123. The cross headers 121 and 123 extend crosswise beneath the coke oven battery and are connected to all of the vertical risers 126 and 128 that are associated with the flues of a given heating wall. Thus, a single header 121 supplies the fuel to all of the vertical riser ducts 126 of a heating wall that includes flues designated by the numeral 114. Similarly, the header 123 supplies gas to all of the vertical riser ducts associated with the heating wall on the opposite side of the coke oven battery that includes the flues designated by the numeral 115.

Where the heating flues are supplied with rich fuel gas, i.e. fuel gas of high calorific value and particularly rich fuel gas containing light oils, the rich fuel gas is supplied from the gas main 124 to the headers 121 or 123 and through the vertical riser ducts 126 or 128. The rich fuel gas is then fed into the series of flues 114 in a heating wall or into the series of flues 115 in the heating wall on the opposite side of the coke oven chamber 112 by means of the plurality of riser ducts 126 or 128. The rich fuel gas is metered into each riser by fuel gas nozzles that have been properly calibrated. The vertical riser ducts 126 and 128 extend from beneath the coke oven battery support mat 130 through the regenerator walls 132 to the respective ports 134 or 136 located in the base of the respective flues 114 or 115. The rich fuel gas is subjected to the elevated temperatures of the hot regenerator walls 132 as it flows upwardly through the vertical riser ducts and is subject to thermal decomposition as later explained. The headers 121 and 123 which supply the gas to the vertical riser ducts are connected to the supply main 124 that extends lengthwise of the coke oven battery.

Figure 8:
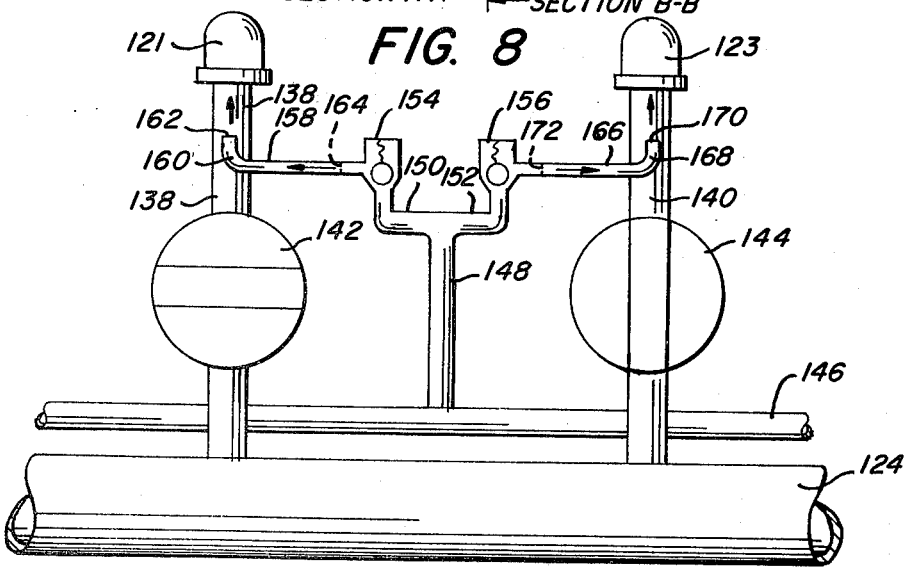
FIG. 8 is an enlarged schematic of the piping and valving connecting the main gas supply conduit and the air supply conduit to the headers extending crosswise beneath a coke oven battery that does not have waste gas recirculation.

As illustrated in greater detail in FIG. 8, the gas main 124 arranged to supply rich fuel gas to the heating flues is connected through piping 138 and 140 to the respective headers 121 and 123. Reversing valves 142 and 144 are positioned in the pipes 138 and 140, respectively, to selectively control the flow of rich gas from the supply main 124 to the headers 121 and 123 to thus control the flow of rich gas to the on flues through the respective vertical riser ducts connected to the respective headers.

A main air supply conduit 146 extends parallel to the rich fuel gas supply main 124 and is arranged to supply air under pressure to the headers 121 and 123 in a controlled manner as later described. A conduit 148 is connected to the air conduit 146 and has a pair of branch conduits 150 and 152 in which flow check valves 154 and 156 are positioned. The branch conduit 150 has a portion 158 that extends from the check valve 154 into pipe 138 on the downstream side of valve 142. The pipe portion 158 has an elbow 160 with an opening 162 arranged so that air is introduced into pipe 138 in the same direction as the rich fuel gas flowing through pipe 138. The pipe portion 158 has an orifice 164, schematically illustrated in FIG. 8, to provide a preselected distribution of flow through the headers 121 and 123 and thus through the vertical riser ducts 126 and 128 to each of the flues 114 and 115 in the heating walls on opposite sides of the coke oven chamber 112. The other branch conduit 152 has a similar portion 166 extending from check valve 156 into the pipe 140 on the downstream side of valve 144. The pipe 166 also has an orifice 172 and an elbow end portion 168 with an opening 170 facing in the direction of gas flow.

In the underjet arrangement illustrated in FIG. 7 where the rich fuel gas is supplied to the flues 114 and 115 from a gas main 124 through headers 121 or 123 and through vertical ducts or risers 126 and 128 difficulties are encountered with the rich gas especially when the light oil remains in the gas. The rich fuel gas as it flows upwardly through the riser ducts that are in the hot regenerator walls thermally decomposes and deposits graphite or carbonaceous materials on the walls of the riser ducts 126 and 128. The carbon or graphitic depositions reduce and sometimes stop the flow of gas into the flues 114 and 115. With the above described apparatus it is now possible to eliminate or substantially reduce the deposition of carbonaceous materials on the walls of vertical riser ducts 126 and 128 in the following manner. Assuming the flues 115 in the heating wall on one side of the coke oven chamber are the on flues and the flues 114 in the heating wall on the opposite side of the coke oven chamber 112 are the off flues, rich gas which contains light oils is supplied through the gas main 124 into the pipe 140. The valve 144 is in an open position, as illustrated in FIG. 8, so that the rich gas flows through valve 144 in the pipe 140 into the header 123. From the header 123 the rich gas flows upwardly through all of the riser ducts 128 into the flues 115 where it is admixed with preheated air from the regenerators 118 adjacent the ports 136 and burners adjacent the base of the flues 115. The hot gaseous products of combustion flow upwardly through flues 115 and through crossover ducts 116 and downwardly through the off flues 114 in the other heating wall. The gaseous products of combustion flow downwardly through conduits similar to conduits 120 and 122 into the cross regenerators to preheat the air flowing upwardly into the flues and then through sole flues 117 into the waste heat flue 119.

Air under pressure is introduced from air supply main 146 into pipe 148. The air flows upwardly through the branch conduits 158 and 166. In the most preferred embodiment approximately one-third of the air flowing through pipe 148 flows past check valve 156 through orifice 172 in pipe 166 into the conduit 140 and two-thirds of the air flowing through pipe 148 flows past check valve 154 through orifice 164 in pipe 158 into the conduit 138. This is the equivalent of 25% of the fuel gas volume being fed to the on flues and 50% of the fuel gas volume being fed to the off flues. This difference in air flow rates through the same size orifices 164 and 172 is caused by the higher pressure on the downstream side of orifice 172 caused by the fuel gas pressure in the header. It should be understood the volume of air to the on flues may be between about 15 to 40% of the fuel gas volume and between about 30% to 75% of the fuel gas volume may be fed to the off flues. In the conduit 140 the air is admixed with rich fuel gas flowing from the supply main 124 through valve 144 and dilutes the rich gas to thereby suppress deposition of carbon in the vertical risers 128.

Simultaneously, air introduced through main supply line 146 flows through pipe 148 into the branch conduit 150 and through conduit 158 into pipe 138 beyond the valve 142. The air is conveyed through the header 121 to the riser ducts 126 and upwardly through the riser ducts 126 into the off flues 114 of the heating wall. The air under pressure supplied to the off flues 114 decarbonizes the vertical risers 126 and removes substantially all of the carbon deposited on the risers 126 during the previous portion of the heating cycle in which the vertical risers 126 were supplied with rich fuel gas.

With this arrangement air is provided simultaneously to dilute the fuel gas in the vertical riser ducts conveying the combustible gas to the vertical flues and to provide air to decarbonize the vertical riser ducts in the off flues. The air added to the fuel gas suppresses the amount of carbon deposited on the vertical riser ducts of the on flues and the air supplied to the off vertical riser ducts is sufficient to consume the carbonaceous material from the previous burning cycle.

In a "hairpin" or twin flue battery without waste gas recirculation or in a gun flue type divided coke oven battery the same gas main and air main with the conduits and reversing valves may be employed to supply air for diluting the rich gas and also to decarbonize the off flue risers. With the gun flue divided coke oven other suitable controls and valving may be provided to admix air under pressure with the rich gas before the gas is introduced into the horizontal duct positioned in the brickwork beneath the coke ovens and above the regenerators. The arrangement illustrated in FIG. 8 is also suitable for use with gun flue type batteries of the Becker crossover type or twin flue type.

Figure 11:
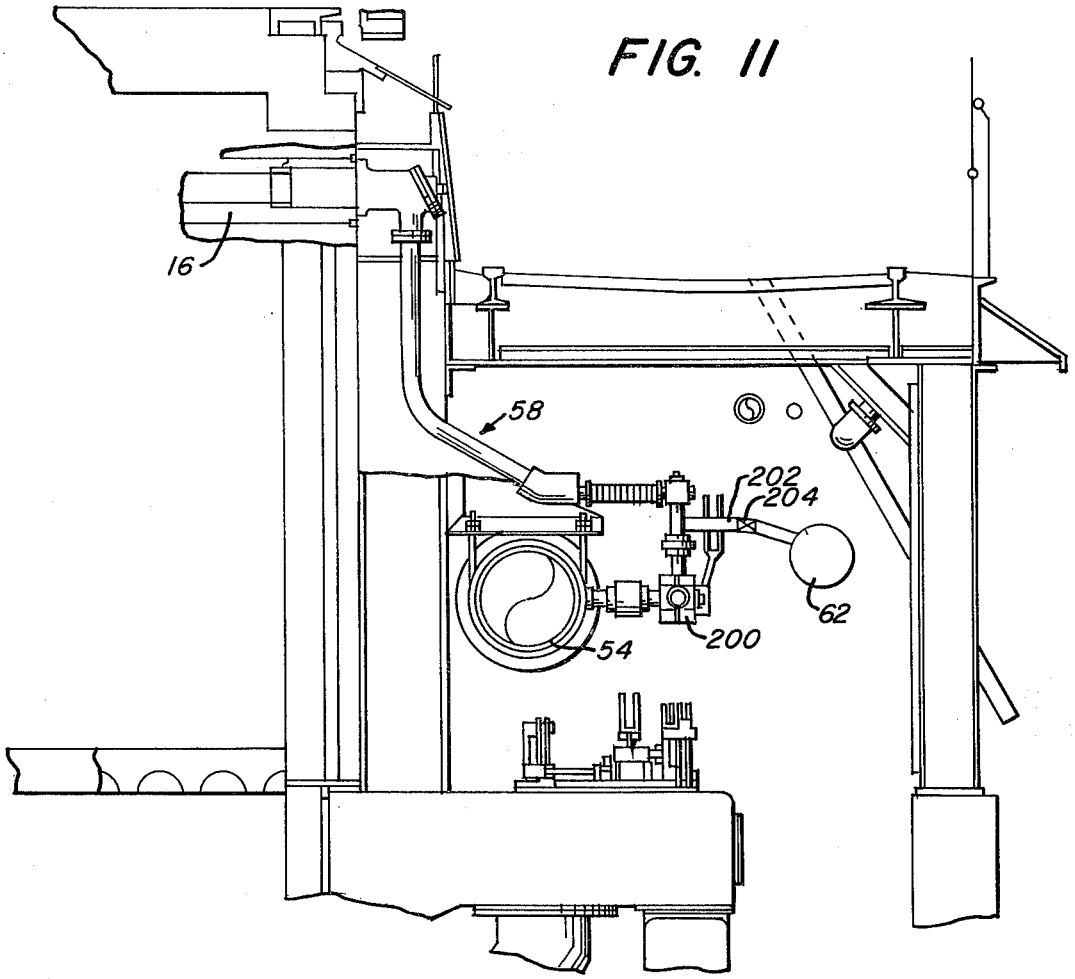
FIG. 11 is an enlarged view of the piping and valving connecting the gas supply main and air supply conduit to a gun flue type coke oven battery.

For example, referring to FIGS. 1, 2 and 11, there is illustrated in FIG. 1 a gun flue single divided coke oven and in FIG. 11 another piping arrangement for a gun flue which may be utilized with any type of gun flue coke oven battery. In FIGS. 1, 2 and 11 the gas main 54 and air main 62 are arranged longitudinally along the side of the oven and are connected to the horizontal duct 16 by means of piping generally designated by the numeral 58. The piping includes a reversing mechanism 200 which controls the flow of gas to the flues 12 on opposite sides of the coke oven chamber so that one group of flues are on flues while the other group of flues on the opposite side of the chamber are off flues. Air under pressure may be connected from conduit 62 to the piping 58 by means of the arrangement illustrated in FIG. 8 where air is supplied to both the on and off flues. Alternately, where it is not desired to supply air to the off flues the air conduit 62 may be connected by means of a pipe 202 to the piping generally designated by the numeral 58. The pipe 202 may include a valve member 204.

It is preferred for each volume of rich fuel gas between about 15 and 40% and most preferably about 25% of a volume of air based on the volume or rich gas is admixed with the rich fuel gas and between about 30 and 75% and most preferably 50% of a volume of air based on a volume of rich fuel gas is introduced into the off flues. With this ratio of air to rich fuel gas the carbon deposition within the vertical riser passageway of the on flues is suppressed substantially by the admixture of about 25% by volume air of the rich gas volume and when the same vertical riser ducts on the reverse cycle are connected to the off flues about 50% by volume air introduced into the header and the vertical riser ducts removes the carbon or graphitic material deposited during the previous on cycle to thus maintain the vertical riser ducts substantially free of carbon deposits.

Where desired, during the reversing cycle valves 142 and 144 may be closed for a preselected length of time so that both of the flues 114 and 115 are the off flues. During this period air is introduced through the pipe 148 into pipes 138 and 140 and into both headers 121 and 123. The air in both headers 121 and 123 flows upwardly through all of the vertical riser ducts 126 and 128. The air removes at least a portion of the carbon remaining in the vertical riser ducts 126 and 128. The air can be supplied to both of the vertical riser ducts 126 and 128 for a period of between 0 and 5 minutes, depending on the amount of carbonaceous material remaining in the vertical riser ducts 126 and 128. Where desired, the air pressure of the air flowing through the main 146 and feeder pipes 148 may be increased during this period to supply a greater amount of air to the respective headers 121 and 123 and riser ducts 126 and 128 than during the heating cycle. The apparatus illustrated in FIGS. 8 and 10 permits supplying air under pressure to both of the headers 121 and 123 while both of the flues 114 and 115 in the heating walls are off flues. The conventional reversing mechanism can be modified to include a special timer device for the reversing machine to pause in this off position wherein both valves 142 and 144 are closed for a preselected period of time.

Figure 10:
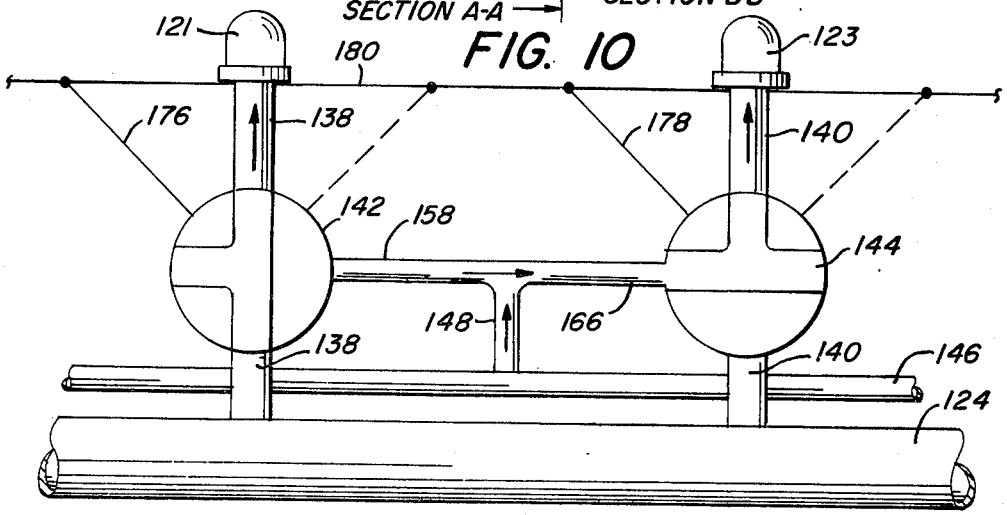
FIG. 10 is an enlarged schematic of the piping and valving connecting the gas supply main and air supply conduit to the headers that extend crosswise beneath coke oven batteries that have waste gas recirculation as illustrated in FIG. 3 and 9.

Referring to FIGS. 9, 10 and 12 there is illustrated another embodiment of the invention wherein a waste gas recirculation duct is provided between interconnected flues. In FIGS. 3 and 4 this embodiment of the invention is illustrated in a hairpin type coke oven battery. For convenience certain of the characters of reference of the underjet crossover coke oven battery illustrated in FIG. 6 will be utilized. The embodiment of the invention illustrated in FIGS. 3 and 4 has proven particularly advantageous in its application to a twin or hairpin coke oven battery as illustrated in FIGS. 3 and 4. Actual experimentation on a full scale hairpin type coke oven battery has exemplified the advantageous features of this invention. It should be understood that the invention is applicable to a twin or hairpin type oven where the induction or recirculation ducts are located in the brickwork above the coke oven battery and connect each pair of twin or hairpin flues in each wall. The invention is also applicable to an underjet crossover oven where the induction or recirculating flues are positioned under the regenerator sole flues in the coke oven battery extending beneath and across the coke oven chamber positioned between the adjacent vertical flues.

Referring to FIG. 12, which is a detailed illustration of the recirculating duct generally designated by the numeral 174 and illustrated in FIG. 9, the recirculating duct 174 is connected to interconnected flues as is illustrated in FIG. 9 and designated by the numerals 126 and 128. The vertical riser ducts 126 and 128 have venturi portions 208 and 210 above the connections 212 and 214 of the induction duct 216. The flow nozzles 218 and 220 are positioned beneath the venturi portions 208 and 210 to control the flow of gas upwardly from the lower portions of the riser ducts. The arrangement illustrated in FIG. 12 is similar to that illustrated in U.S. Pat. No. 2,306,678 and permits a portion of the gaseous products of combustion or waste gas to flow downwardly through the vertical riser duct associated with the off flues and through the transverse induction duct 216 to the vertical riser ducts associated with the on flues. A controlled amount of waste gas is admixed with the rich fuel gas supplied from the gas main through the respective headers as, for example, in FIG. 9 the gas supplied from gas main 124 through the headers 121 and 123. The waste gas dilutes the rich fuel gas and thus suppresses carbon deposition as the gas flows upwardly through the vertical riser ducts of the on flues.

Referring to FIGS. 9 and 10 there is illustrated a main air supply line 146 that is arranged to supply air under pressure to the pipe 148. The pipe 148 has branch portions 158 and 166 that are connected to the respective valves 142 and 144. The actuators 176 and 178 for valves 142 and 144 are connected to a reversing cable 180 that is arranged to alternately supply rich gas to the headers for the flues on opposite sides of the coke oven chamber 112. In FIGS. 9 and 10 the flues 114 are the on flues and valve 142 is positioned to permit rich gas to flow from gas main 124 through pipe 138 to header 121 and then through the vertical riser ducts 126 in the flues 114. Valve 142 is so positioned that it prevents the flow of air (or lean dilution gas) from main 146 through branch conduits 158 into pipe 138 and header 121 so that only rich gas flows upwardly through pipe 138 into header 121 and into vertical riser ducts 126. Flues 115, which are the off flues, have valve 144 positioned to prevent the flow of rich gas from gas main 124 through pipe 140 into header 123. However, the valve 144 is positioned to permit the flow of air or lean dilution gas through branch conduit 166 into pipe 140 and into header 123. The gas flowing through header 123 flows upwardly through the lower portion of riser ducts 128 and is admixed with the waste gas flowing downwardly through vertical riser ducts 128 to thereby dilute that portion of the waste gas that flows through the induction ducts 174 into the vertical riser ducts 126 associated with the on flues 114. With this arrangement the dilution of the waste gas with air or lean dilution gas suppresses the deposition of carbon in the riser ducts associated with the on flues. Where desired, lean gas may be substituted for the air in air main 146 and supplied to the induction ducts 174 for admixture with the waste gas flowing downwardly through the vertical riser ducts associated with the off flues. The air admixed with the waste gas provides excess air, $CO_2$ and $H_2O$ vapor in the waste gas that circulates through the crossover ducts 116 and downwardly through the off flues 115 and through the riser ducts 128 associated therewith to decarbonize any carbon deposited during the previous on cycle. It should be understood that the above described arrangement may also be utilized with the twin flue coke oven battery illustrated in FIGS. 3 and 4.

With the above described arrangement in either of the embodiments illustrated the air at ambient temperature flows upwardly past the nozzle in the riser to the off flue and tends to maintain the nozzle cool and prevent the recirculating waste gas from overheating the nozzle. The suppressing of carbon deposition in the riser associated with the on flue reduces substantially the excess air that was previously required to remove the carbon deposited in the vertical riser of the off flue. This improves combustion and reduces substantially heat losses incurred with the use of very high excess air.

On reversal, as illustrated in FIG. 10, the valve 142 is arranged to supply air to the header 121 and the valve 144 is arranged to supply rich gas to the header 123 so that flues 115 are the on flues and flues 114 are the off flues. The air of lean gas supplied to the conduit 138 and header 121 is admixed with the waste gas flowing downwardly through the vertical riser ducts 126 in the induction ducts 174 (FIG. 9) and dilutes the rich gas flowing upwardly through the vertical riser 128 to thus suppress carbon deposition in the vertical riser ducts associated with the on flues and provide controlled quantities of excess air for decarbonizing any carbon deposited in the off flues during the previous cycle. Where desired, the reversing apparatus may be modified to permit air to be supplied through both pipes 138 and 140 to headers 121 and 123 so that air is supplied to all of the vertical riser ducts 126 and 128 during the reversing cycle when both flues are off flues to thus remove any carbon remaining in the vertical riser ducts 126 and 128.

Neither of the above embodiments of air or lean gas for dilution would normally be required with conventional size coke ovens that include light oil recovery equipment. The systems disclosed in the two embodiments may be required where the light oil is not removed from the rich gas and may also be required in ovens where there are high level gas ports in the flues and where the ovens are operating at fast coking rates even if the rich fuel gas is free of light oil. In this latter arrangement the fuel gas must pass through the vertical duct within the flue at high temperature levels which is conducive to the deposition of carbon. It should be understood, however, that the features of this invention may be utilized with any coke oven structure in which a pair of heating flues are interconnected so that combustion takes place in one flue and the gaseous products of combustion flow downwardly through an interconnected flue. The admixing of air with the fuel gas suppresses the deposition of carbonaceous material in the vertical riser ducts of the on flue and also reduces the amount of excess air required in the combustion process. The air supplied to the off flue in one embodiment reduces substantially the temperature of the burners and increases their useful life.

According to the provisions of the patent statutes, we have explained the principle, preferred construction and mode of operation of our invention and have illustrated and described what we now consider to represent its best embodiments. However, we desire to have it understood that, within the scope of the appended claims, the invention may be practiced otherwise than specifically illustrated and described.

We claim:

1. In a regenerative coke oven battery the combination comprising, a pair of flues operable alternately in on and off combustion condition, a rich fuel gas supply main extending along said coke oven battery, a second gas supply main extending along said coke oven battery adjacent said rich fuel gas supply main, a first header and a second header for said flues positioned beneath said flues, vertical riser ducts connected to said headers and extending vertically into said flues, first connecting means connecting said rich fuel gas supply main to said headers, second connecting means connecting said second gas supply main to said first connecting means, gas flow control valve means in said first connecting means to control the flow of rich fuel gas from said rich fuel gas supply main to said headers, said gas flow control valve means also operable to simultaneously supply both rich fuel gas and said second gas to one of said headers for admixture in said vertical duct to thereby dilute said rich fuel gas and suppress the deposition of carbonaceous material in said vertical riser ducts, and means to supply said second gas under pressure to said first connecting means for admixture with said rich fuel gas in one of said headers to thereby dilute said rich fuel gas.

2. A regenerative coke oven battery as set forth in claim 1 which includes, means to supply said second gas to said second header while said second gas is being supplied to said first header so that said second gas in said second header flows upwardly through said vertical riser ducts connected thereto and removes at least a portion of the carbon deposited in said vertical riser ducts.

3. A regenerative coke oven battery as set forth in claim 1 in which, said second connecting means includes orifices for a preselected distribution of said second gas to said respective headers.

4. In a regenerative coke oven battery as set forth in claim 1 in which said second connecting means includes, check valves to prevent rich fuel gas from flowing through said second connecting means into the other header.

5. A regenerative coke oven battery as set forth in claim 2 in which, said second gas is air, and means for controlling the flow of air so that between about 15 to 40% by volume air for each volume of rich gas is introduced into said header supplying rich fuel gas to the on flues.

6. A regenerative coke oven battery as set forth in claim 2 in which, said second gas is air, and means for controlling the flow of air so that between about 30 to 75% by volume air for each volume of rich gas is introduced into the header supplying said air to said off flues.

7. A regenerative coke oven battery as set forth in claim 1 which includes, induction ducts connecting the vertical riser ducts of interconnected on and off flues so that a portion of the waste gas from the off flues is conveyed downwardly through the riser ducts associated with the off flues through said induction ducts and into said riser ducts associated with said on flues for admixture with said rich fuel gas in said riser ducts associated with said on flues, and means to introduce said second gas under pressure into said riser ducts associated with said off flues for admixture with said portion of said waste gas flowing downwardly in said riser ducts associated with said off flues.

8. A regenerative coke oven battery as set forth in claim 7 in which, said second gas is air.

9. A regenerative coke oven battery as set forth in claim 7 in which, said second gas is a lean fuel gas.

10. A method to suppress the carbonaceous deposits in the vertical riser ducts of a regenerative coke oven battery comprising, introducing rich fuel gas into a header connected to vertical riser ducts of an on flue, simultaneously introducing air into the header connected to the vertical riser ducts of the on flues and into the header connected to vertical riser ducts connected to an off flue, said air introduced into said header connected to said on flue operable to dilute said rich fuel gas in said vertical riser ducts and suppress the deposition of carbonaceous material in said vertical riser ducts, and said air introduced into said header connected to said vertical riser ducts of said off flue operable to remove at least a portion of the carbonaceous material deposited in said vertical riser ducts.

11. A method to suppress the carbonaceous deposits in the vertical riser ducts of a regenerative coke oven battery comprising, connecting pairs of flues with a recirculation duct operable to recirculate a portion of the waste gas from the off flue to the on flue at a location adjacent the nozzles for supplying gas to said respective flues, introducing rich fuel gas into a header connected to the nozzles of on flues of said pairs of flues, simultaneously introducing a second gas into a header connected to the nozzles of off flues, said second gas passing through said nozzles and mixing said second gas with said waste gas flowing through said recirculation duct, and thereafter admixing said mixture of said second gas and waste gas with said rich gas flowing through said nozzles into said on flues to thereby suppress the deposition of carbonaceous material in the vertical riser ducts connected to said on flues.

* * * * *